United States Patent [19]

Vendelin et al.

[11] Patent Number: 4,717,084

[45] Date of Patent: Jan. 5, 1988

[54] HYDRAULIC SYSTEM FOR REMOTE OPERABLE CONE CRUSHERS

[75] Inventors: John C. Vendelin, Springfield; David F. Peaks, Eugene, both of Oreg.

[73] Assignee: Cedarapids, Inc., Cedar Rapids, Iowa

[21] Appl. No.: 944,020

[22] Filed: Dec. 22, 1986

[51] Int. Cl.[4] ..... B02L 2/00

[52] U.S. Cl. ..... 241/207; 241/286; 241/290

[58] Field of Search ..... 241/207–216, 241/286, 290

[56] References Cited

U.S. PATENT DOCUMENTS

| | | |
|---|---|---|
| Re. 27,970 | 4/1974 | Johnson . |
| 2,791,383 | 5/1957 | Kjelgaard . |
| 3,140,835 | 7/1964 | Balmer et al. . |
| 3,337,143 | 8/1967 | Johnson . |
| 3,396,916 | 8/1968 | Kemnitz et al. . |
| 3,420,457 | 1/1969 | Peters et al. . |
| 3,454,230 | 7/1969 | Allen . |
| 3,604,640 | 9/1971 | Webster . |
| 3,754,716 | 8/1973 | Webster . |
| 3,759,453 | 9/1973 | Johnson . |
| 3,797,760 | 3/1974 | Davis et al. . |
| 3,873,037 | 5/1975 | Decker et al. . |

*Primary Examiner*—Timothy V. Eley

*Attorney, Agent, or Firm*—Simmons, Perrine, Albright & Ellwood

[57] ABSTRACT

A remote operable cone crusher employing all-hydraulic adjust and clamping systems features a hydraulic "intensifier" for the clamp cylinders and an auxiliary pressure maintaining circuit for the adjust cylinders in order to overcome "creep" under load.

9 Claims, 4 Drawing Figures

HYDRAULIC SYSTEM FOR REMOTE OPERABLE CONE CRUSHERS

BACKGROUND OF THE INVENTION

The setting of a cone crusher, that is, the "gap" between the mantle and the bowl liner, is typically adjusted in essentially one of two ways in those designs in which the bowl is moved relative to the head (as opposed to those in which the head is moved relative to the bowl, as in U.S. Pat. No. 3,873,037, for instance). Either the bowl and its liner are threaded into the bowl support and the bowl rotated relative to the bowl support to adjust the setting, as in U.S. Pat. Nos. 3,140,835; 3,420,457; and 3,454,230, for example, or the bowl support is simply moved rectilinearly vertically of the frame by hydraulic means, as in U.S. Pat. Nos. 2,791,383; 3,396,916; 3,604,640; and 3,754,716, for example, or by jack screws as in U.S. Pat. No. 3,337,143. Whichever approach is used, some means are also employed to "lock" the bowl to the bowl support in the former instances, or the bowl support to the crusher frame in the latter instances, in order further to resist crushing forces imposed upon the bowl and liner. In the former a threaded "locking ring" is typically used as in U.S. Pat. Nos. 3,140,835 and 3,420,457, the rings being hydraulically impelled. In the latter instances either the hydraulic adjusting means are in effect "locked up" as in U.S. Pat. No. 2,791,383 using double acting hydraulic cylinders, and/or an annular "wedge ring" made up of several segments is used as in U.S. Pat. Nos. 3,337,143; 3,604,640; and 3,754,716, the wedge rings being hydraulically actuated and operative between the bowl support and the crusher frame.

Nowadays the trend is more and more towards controlling operation of a cone crusher, including its setting, from a location remote from the crusher itself, such as a station from which an entire crushing plant, including feeders, screens, and so forth, is controlled. If the bowl is threaded into the bowl support and a hydraulically actuated locking ring is employed, remote adjustment is possible and is said to have been achieved but requires an elaborate and expensive system of hydraulic rams and pawls to rotate the bowl, as in U.S. Pat. No. 3,759,453. Furthermore, the adjustment can only be in finite steps, dependent upon the stroke of the rams, rather than infinite. Another difficulty in that instance is that remote operation demands some means at the crusher for accurately measuring and transmitting the crusher's setting. This is not easily provided both because the bowl must rotate to adjust the setting and because of the rather coarse nature of the buttress threads used between the bowl and its support. Nor can remote setting of a cone crusher in which the bowl support is moved relative to the frame be accomplished if shim stacks are employed, as in U.S. Pat. Nos. Re. 27,970 and 3,337,143, to adjust the setting. Obviously, then, the best solution is to move the bowl support relative to the frame using double acting hydraulic cylinders or the like interposed between the frame and the bowl support, and then "lock-up" the setting using hydraulically actuated clamps, since an all-hydraulic system lends itself more readily to remote control and to infinite and so more precise adjustment. The position of the liner relative to the mantle can then be measured by well-known means, such as the linear potentiometers shown in U.S. Pat. No. 3,754,716, for instance.

But an all-hydraulic system is beset with the problem of "creep", that is, a gradual increase in the setting when the crusher is operating under load. Even when fluid is "locked" on both sides of the pistons of the adjusting cylinders and even when in addition a wedge ring impelled by hydraulic clamp cylinders is used to clamp the bowl support relative to the frame, "creep" nevertheless occurs using fluid pressures in the adjust and clamp cylinders in the range of 3,000 psi which are typical of those supplied by the hydraulic pumps employed in crushing plants and the like. "Creep" ensues even at those pressures and despite the wedge ring because of system leakage and especially because of a certain amount of compression of the hydraulic fluid in the adjusting cylinders owing to movement of the bowl support relative to the frame despite the clamp of the wedge ring. This could probably be overcome by raising the clamp pressure on the wedge ring to, say, 10,000 psi, but that would require a prohibitively expensive pump as well as involve dangerously high line pressures.

Another aspect of the "creep" problem involves the overload system used to increase the setting temporarily should uncrushable matter such as tramp iron be introduced into the crusher. Such systems are independent of that used to adjust crushing setting and typically consist of springs, or hydraulic cylinders plus an accumulator as in U.S. Pat. No. Re. 27,970, interposed between the bowl and the bowl support such that the bowl can lift relative to the bowl support. Consequently, the hydraulic locking system of the crusher must be more powerful than the overload system so that passage of tramp iron, for instance, will only move the bowl relative to the bowl support but not the latter relative to the frame and thus disturb the setting. Hence not only must the locking system resist "creep" during normal crushing loads but also during the higher loads imposed upon it when the overload system operates to relieve the setting during passage of uncrushable material.

The primary object of the present invention is thus an improved all-hydraulic system for adjusting the setting of a cone crusher operable from a remote location, which system overcomes the "creep" problem.

SUMMARY OF THE INVENTION

"Creep" is removed chiefly by the use of a hydraulic "intensifier" in the hydraulic clamp system. One line leads from the pump to the clamp cylinders and another parallel line from the pump to the intensifier which in turn raises the pressure in the clamp cylinders above that supplied by the pump. As an added precaution, during "lock up" of the adjust cylinders when the 3-position valves controlling flow from the pump in and out of the adjust cylinders are in their center or neutral position, an auxiliary circuit from the pump into the adjust cylinders is preferably incorporated so that full pressure is maintained on those sides of the adjust cylinder pistons receiving crushing loads.

Flow to the clamp cylinders and the intensifier and to the adjust cylinders through the auxilairy circuit is controlled by a pair of 2-position hydraulic clamp valves and various other components so that by manipulating both valves the intensifier, the clamp cylinders and the auxiliary circuit can in effect all be dropped completely out of the system in order to adjust crusher setting via the adjust valves, or by manipulating one of the clamp valves only the intensifier and the auxiliary circuit can be dropped from the system but some pressure can nevertheless be maintained in the clamp cylinders so that the setting can be adjusted under load. The operation of the pump and all the adjust and clamp valves, which are solenoid actuated, is controlled by a remote "controller", the setting being measured at the crusher by three "position/displacement transducers" in the form of potentiometers somewhat as shown in U.S. Pat. No. 3,754,716. Once the crusher's setting has been established through the controller, operation of the crusher is thenceforth automatic. Any impermissible deviation in the setting owing to wear can be determined from and corrected by the controller. Manual override of the controller is also provided for.

Other features and advantages will become apparent from the drawings and the more detailed description which follows.

DETAILED DESCRIPTION OF THE PREFERRED EMBODIMENT

Figure 1:
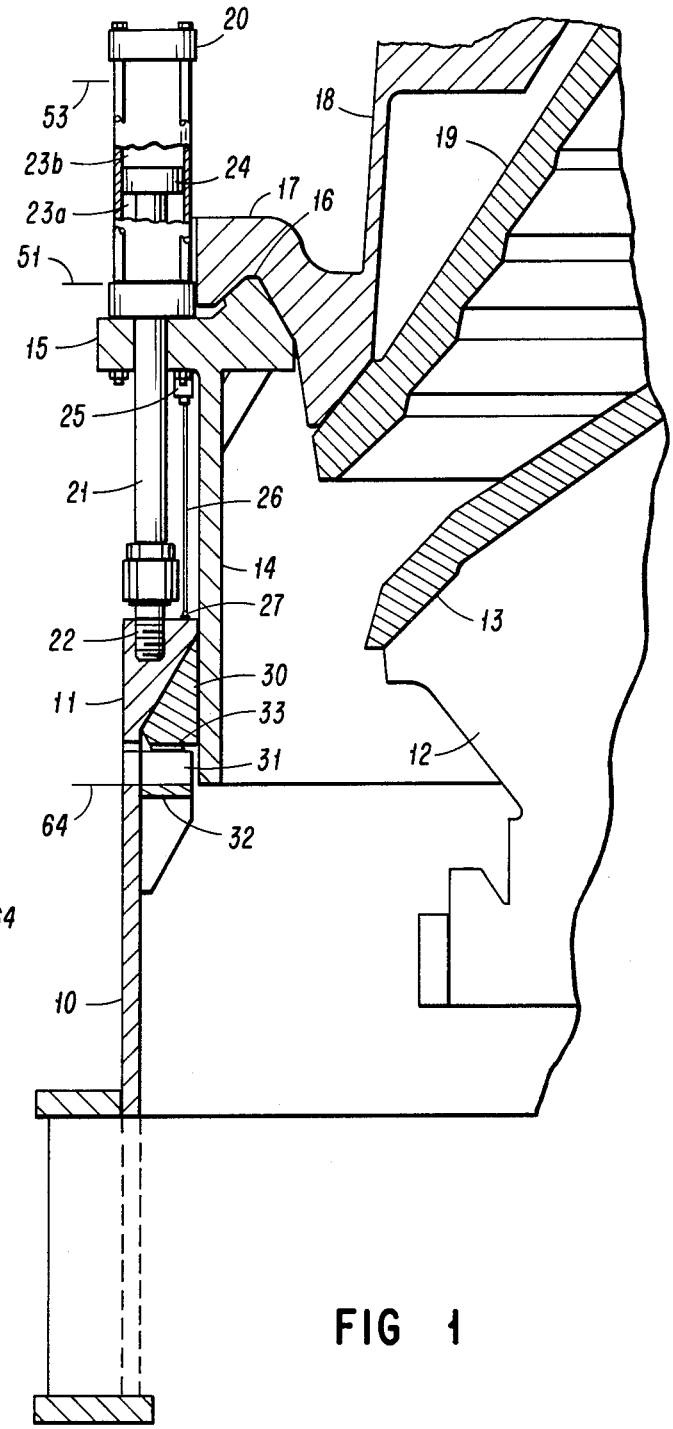
FIG. 1 is a partial axial section through a cone crusher embodying the invention illustrating the arrangement of the adjust and clamp cylinders and the clamp ring relative to the frame, bowl and bowl support.

Turning first to FIG. 1 the cone crusher illustrated includes a generally cylindrical frame 10 having a cuniform shaped upper ledge 11 surrounding the gyrating head 12 and its surmounted mantle 13. The cylindrical bowl support 14 is disposed within the upper portion of the frame 10 and rectilinearly vertically movable axially thereof. The bowl support 14 is topped by an integral annular flange 15 provided with an upstanding apical rim 16 adjacent its inner margin. The rim 16 seats a lip 17 circumventing a bowl 18 submounted in turn by a liner 19 in spaced crushing relation to the mantle 13 below.

The setting of the crusher, the gap between the mantle 13 and liner 19, is adjusted by 12 double acting hydraulic cylinders 20, one of which is shown in FIG. 1, divided into three banks of four each. The cylinders 20 are equally spaced around and bolted to the bowl support flange 15, extending upright therefrom just outboard of the bowl lip 17, the piston rods 21 extending down through the flange 15 and threading at 22 into the frame ledge 11 therebelow. Fluid into and out of the chambers **23*a* and 23*b* on each side of the pistons 24 will thus raise or lower the bowl support 14 and thus the bowl 18 and liner 19 relative to the mantle 13 and so adjust the crusher's setting. That setting in turn is measured by three equally spaced potentiometers 25, one for each bank of cylinders 20, secured about the underside of the bowl support flange 15. The potentiometers 25 are "Model PT101 Position/Displacement Transducers" manufactured by Celesco Transducer Products, Inc. of Canoga Park, Calif., and are cable operated, their cables 26 being secured at 27 to the frame ledge 11** below.

Figure 2:
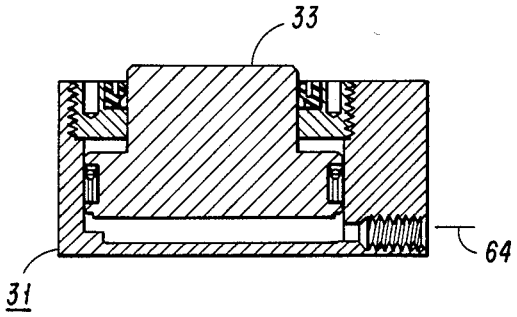
FIG. 2 is an axial sectional view of one of the clamp cylinders.

The bowl support 14 is clamped to the frame 10 in order to secure the crusher setting by an annular clamp ring 30, triangular in cross-section and consisting of several segments, which forms a wedge between the inclined inner face of the frame ledge 11 and the adjacent wall of the bowl support 14. Clamping is achieved by 16 squat, single acting clamp cylinders 31, one of which is illustrated in FIG. 2, disposed on an annular shelf 32 attached to the frame 10 below the ring 30, their pistons 33 urging the ring 30 upwards to lock the bowl support 14 relative to the frame 10.

Figure 3:
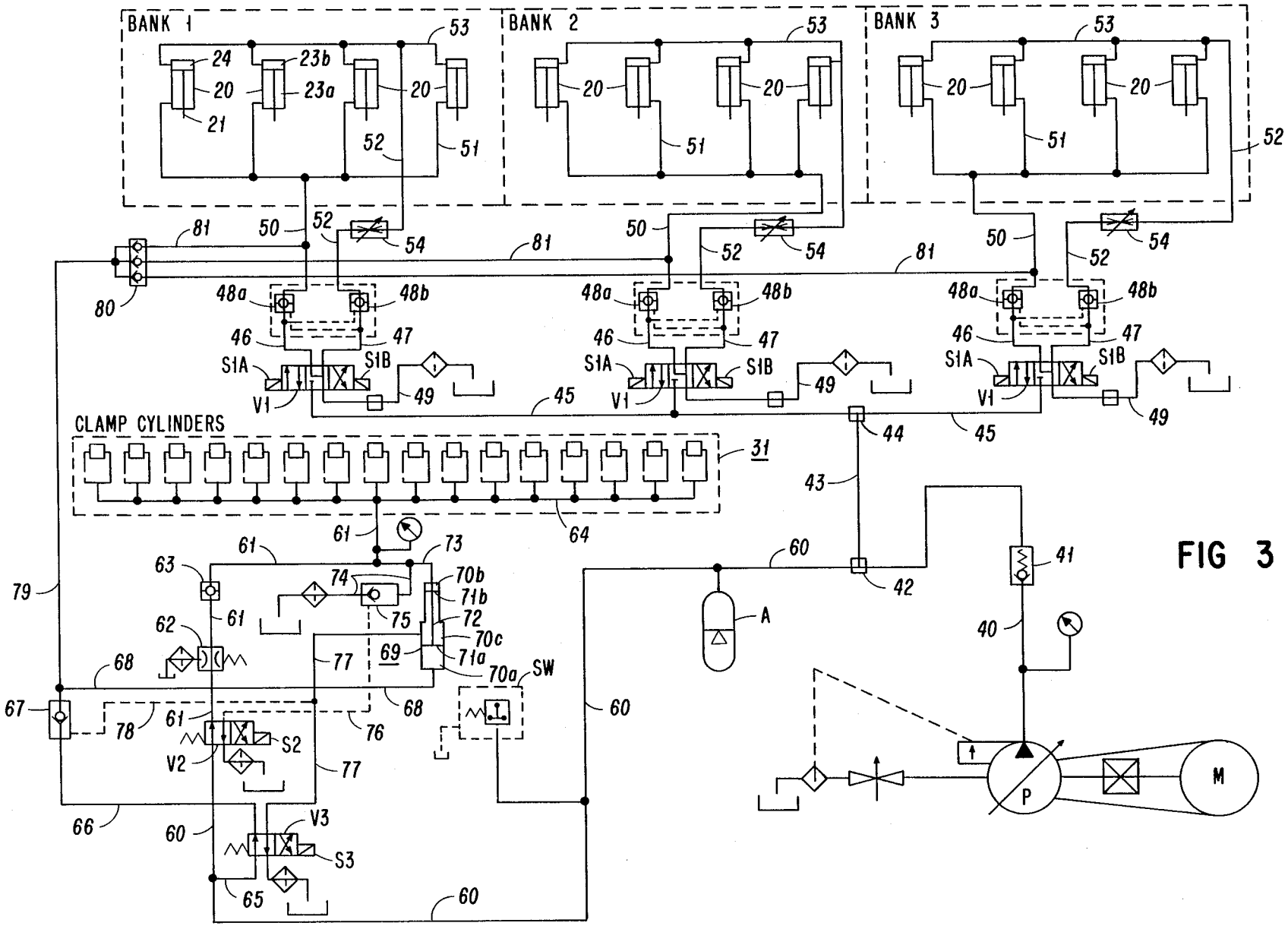
FIG. 3 is a schematic of the hydraulic circuitry of the crusher, the overload circuit not being shown.

Turning now to the hydraulic system schematically illustrated in FIG. 3, a hydraulic pump P driven by a motor M supplies fluid under pressure, 3,000 psi in the case of a working embodiment of the invention incorporated in a 66 inch cone crusher. The pump P is of the pressure compensated type so that it maintains that pressure regardless of load. The output of the pump P is led through a line 40 and a check valve 41 to a manifold block 42 supplying the crusher adjust and clamp systems. The former system is taken off through a line 43, a manifold block 44 and lines 45 to a trio of 3-position directional control valves V1, one for each bank of adjust cylinders 20, operated by solenoids S1A and S1B which are responsive in turn to their respective transducers 25. The valves V1 are connected by lines 46 and 47 to three banks of twin pilot operated check valves **48*a* and 48*b* and by lines 49 to tank. From the check valves 48*a* and 48*b* lines 50 and 51 lead to the chambers 23*a* of the cylinders 20 and lines 52 and 53 through needle valves 54 lead to the chambers 22*b* of the cylinders 20. Accordingly, shifting valves V1 from their neutral position as shown in FIG. 3 to the right by solenoids S1A will supply fluid through lines 45, 46, check valves 48*a*, lines 50 and 51 to the piston chambers 23*a* and at the same time release fluid from the chambers 23*b* through lines 53, 52, needle valves 54, check valves 48*b* and lines 47 and 49 to tank, pressure in the lines 46 unseating the check valves 48*b* owing to the pressure drop caused by the needle valves 54. The bonnet support 18 will therefore lower (assuming the clamp cylinders 31 are deactivated) and so decrease the crusher's setting. Shifting the valves V1 to the left by the solenoids S1B will supply fluid through lines 47, check valves 48*b*, lines 52, needle valves 54 and lines 53 to the piston chambers 23*b* and at the same time release fluid from the chambers 23*a* through lines 51 and 50, check valves 48*a*, and lines 46 and 49 to tank, pressure in the lines 47 unseating the check valves 48*a* owing to the fact that pressure in the lines 51 and 50 is less than that in lines 47 owing to the needle valves 54. The bonnet support 18 will therefore rise (again assuming the clamp cylinders 31** are deactivated) and so increase the crusher's setting.

The crusher's clamp system is taken off from the manifold block 42 through a line 60 into which are tied an accumulator A to maintain pressure in the line 60 when pump P is not operating and a pressure switch SW which turns on pump P when the pressure in line 60 drops below a selected minimum. The line 60 in turn leads to a 2-position directional control valve V2 operated by a solenoid S2 from which a line 61 through an adjustable pressure reducing valve 62 and a check valve 63 enters a manifold line 64 connecting the clamp cylinders 31. A line 65 is taken off the line 60 to another 2-position directional control valve V3 operated by a solenoid S3 from which a line 66 leads through a pilot operated check valve 67 and a line 68 to a hydraulic intensifier 69. The latter is in the form of a stepped cylinder having greater and lesser diameter bores forming chambers **70*a* and 70*b* respectively in which spaced pistons 71***a* and 71*b* respectively operate, the line 68 entering the chamber 70*a*. The pistons 71*a* and 71*b* are interconnected by a piston rod 72 through an intermediate chamber 70*c* between the two pistons. A line 73 leads from the chamber 70*b* to the line 61 and a line 74 from line 73 to tank through a pilot operated check valve 75, the latter being tied by a pilot line 76 to tank through the valve V2 when in the position shown in FIG. 3. A line 77 connects the intensifier chamber 70*c* to tank through valve V3 when in the position shown in FIG. 3, and a pilot line 78 from line 77 ties the latter line to the check valve 67. Finally, a line 79 from the line 68 leads to a battery of three check valves 80 and from the latter valves three lines 81 connect into lines 50 to each bank of adjust cylinders 20. Operation of the clamp system is as follows:

With the valves V1, V2 and V3 in the positions shown the adjust cylinders 20 are immobilized and fluid is supplied from line 60 through valve V2, line 61, pressure reducing valve 62, and check valve 63 to the clamp cylinders 31 and through line 73 to the chamber 70*b* of the intensifier 69. In the working embodiment of the invention mentioned the pressure in the line 61 downstream of the pressure reducing valve 62 is dropped to 1,500 psi from the 3,000 psi pressure in line 60 from the pump P. At the same time fluid at 3,000 psi through lines 60 and 65, valve V3, line 66, check valve 67 and line 68 is supplied to chamber 70*a* of the intensifier 69. The area of its piston 71*a* is thrice that of its piston 71*b* whence, after equalization of the pressures in chambers 70*a* and 70*b* owing to movement of pistons 71*a* and 71*b*, the pressure in line 73 and thus in line 61 downstream of the check valve 63 and in the clamp cylinders 31 rises to 9,000 psi, fluid in the intensifier chamber 70*c* being drained to tank through line 77 and valve V3. Simultaneously, fluid at 3,000 psi through lines 60 and 65, valve V3, line 66, check valve 67, line 79, check valves 80 and lines 81, 50 and 51 is supplied to the chambers 23*a* of the adjust cylinders 20 which resist crushing loads in order to compensate for any leakage in the crusher adjust system which at that time, of course, is shut off from the pump P since valves V1 are in their neutral position.

In order to release all pressure on the clamp cylinders 31 prior to adjustment of the crusher's setting when not under load, the solenoids S2 and S3 are energized and thus shift valves V2 and V3 to the left in FIG. 3. Pressure from line 60 is thus applied through valve V2 and pilot line 76 to the pilot check valve 75, opening it and allowing fluid from the cylinders 31 to drain to tank through lines 64, 61, 73 and 74, thus relieving all pressure in those components. At the same time pressure in line 61 between the check valve 63 and valve V2 is relieved through the latter to tank. Pressure through lines 60, 65, valve V3 and line 77 is applied to the intensifier chamber 70*c* between its pistons and through pilot line 78 to the pilot check valve 67, opening the latter valve and releasing fluid from the intensifier chamber 70*a* as pistons 71*a* and 71*b* conjointly retreat owing to the fluid supplied to chamber 70*c*, the fluid from chamber 70*a* passing to tank through lines 68 and 66 and valve V3. The intensifier 69 is thus dropped from the system. Simultaneously, pressure is relieved in line 79 so that pressure no longer acts through the check valves 80, lines 81, 50 and 51 on the adjust cylinders 20 which then can be activated by valves V1 to alter the setting in the manner previously described. In order to adjust the crusher under load, only valve V3 is shifted by its solenoid S3 which in turn drops the intensifier 69 out of the system in the manner just described. However, 1,500 psi pressure is maintained in the clamp cylinders 31 owing to the fact that pressure is still supplied through line 60, valve V2 to line 61, pressure reducing valve 62, check valve 63 and line 64 to the cylinders 31.

Figure 4:
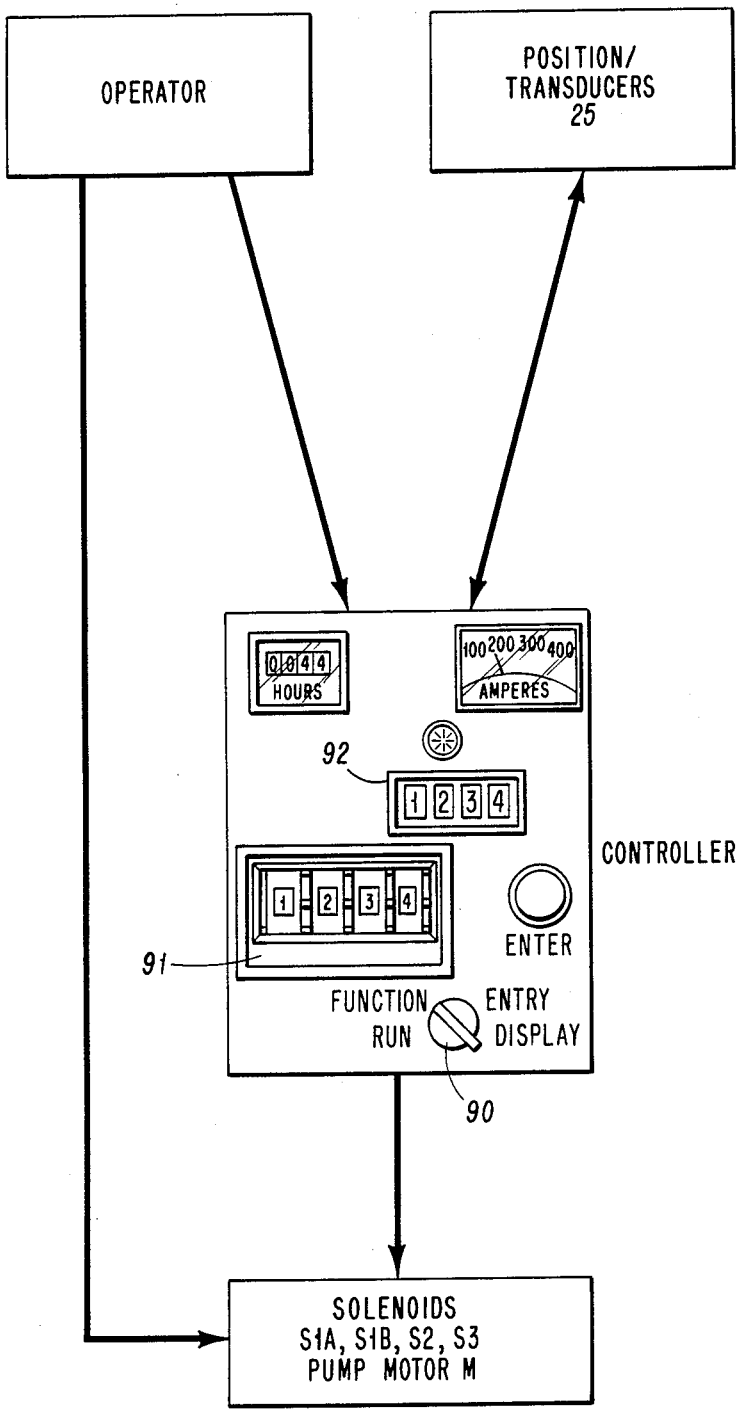
FIG. 4 is a block diagram of the remote control system.

As mentioned, operation of the pump motor M and the valves V1, V2 and V3 via their solenoids S1A, S1B, S2 and S3, as well as the drive for the head 12, is through a "Controller" whose front panel is illustrated in FIG. 4. Briefly, so far as pertinent here, when the four-position selector 90 is in its "FUNCTION" mode, the transducers 25 are calibrated to assure that the bowl support 14 is level with the frame 10. Then the zero "closed side setting" is established by entry of a "code number" on the thumb wheel module 91. Solenoids S1A are thereupon activated, after activation of solenoids S2 and S3 to shift valves V2 and V3 to relieve all pressure on the clamp cylinders 31, whereupon adjust cylinders 20 lower the bowl 18 in the manner previously described until the liner 19 touches the mantle 13. The resulting input from the transducers 25 is recorded in the Controller's memory. The desired setting is dialed in the module 91 and shown at the LED display 92. The Controller sequences the valves V1, V2 and V3 via their solenoids S1A, S1B, S2 and S3 as previously described to raise the bowl 18 until the transducers 25 indicate that the desired "gap" between the mantle 13 and liner 19 is reached, at which time the valves V1, V2 and V3 are repositioned as shown in FIG. 3 to clamp everything together. When the selector 90 is in the "RUN" mode and the crusher is operating, the Controller maintains the valves V1, V2 and V3 in the positions shown in FIG. 3. Any deviation in the setting, owing to component malfunction or undue hydraulic leakage, will be shown on the LED display 90 and if it is beyond a maximum tolerance entered in the Controller's memory through the module 91, the solenoid S3 only will be activated to shift valve V3, thus dropping out the intensifier 69. Then the solenoids S1A or S1B will be activated to cause valves V1 to raise or lower the bowl 18 to restore the setting while the crusher is operating under load, all the foregoing being accomplished automatically. Other monitoring functions are also provided by the Controller, including measurement of wear on the mantle 13 and liner 19, the design and other details of the Controller being well within the skill of those in the art concerned to provide and unnecessary to describe further since they are not part of the present invention. A manual control panel (not shown) is also provided at the crusher itself by which the Controller can be bypassed, as indicated in FIG. 4, and the crusher operated on the spot by manual switches controlling the pump, solenoids and crusher drive.

Though the invention has been described in terms of a particular embodiment, being the best mode known of carrying out the invention, it is not limited to that embodiment alone. Instead, the following claims are to be read as encompassing all adaptations and modifications of the invention falling within its spirit and scope.

We claim:

1. In a cone crusher having a frame, a gyratory head carried by the frame and surmounted by a mantle, a bowl carried by the frame and submounted by a bowl liner above and in spaced crushing relation to the mantle, the bowl and liner being vertically adjustable by hydraulic means effective to move the bowl and liner rectilinearly of the frame in order to adjust said spacing between the mantle and the liner, and means effective to clamp the bowl relative to the frame in a selected adjusted position, the clamping means including one or more clamping members movable into and out of clamping relation with respect to the frame and bowl, a plurality of hydraulic clamp cylinders effective when pressurized to impel the clamping members into said clamping relation, and a hydraulic pump for supply of hydraulic fluid at a first pressure to the clamp cylinders, the improvement including hydraulic intensifier means disposed between the pump and the clamp cylinders and fluid connected to each, the hydraulic intensifier means supplying fluid to the clamp cylinders at a second pressure greater than the first pressure, and first hydraulic clamp valve means between the pump and the intensifier means for controlling supply of hydraulic fluid to and from the intensifier means to activate and deactivate the same.

2. The crusher of claim 1 wherein the intensifier means comprises a stepped, closed end cylinder having first and second bores, the diameter of the first bore being greater than that of the second bore, first and second pistons respectively slidably operative in the bores, a first chamber in the cylinder between the first piston and the adjacent closed end of the first bore, a second chamber in the cylinder between the second piston and the adjacent closed end of the second bore, and a third chamber in the cylinder between the first and second pistons, the pistons being spaced from each other and interconnected through the third chamber for conjoint operation, the first clamp valve means having clamp and relief positions, the first clamp valve means in its clamp position supplying fluid from the pump to the first chamber and releasing fluid from the third chamber effective to activate the intensifier means, the second chamber being fluid connected to the clamp cylinders, the first clamp valve means in its relief position supplying fluid to the third chamber and releasing fluid from the first chamber effective to deactivate the intensifier means and thereby reduce the pressure in the clamp cylinders.

3. The crusher of claim 2 including second hydraulic clamp valve means having clamp and relief positions disposed between the pump and the clamp cylinders and fluid connected to each in parallel with the intensifier means and the first clamp valve means, pressure reducing means disposed between the second clamp valve means and the clamp cylinders and clamp check valve means disposed between the pressure reducing means and the clamp cylinders effective to allow fluid flow to but not from the clamp cylinders, the second clamp valve means in its clamp position supplying fluid through the check clamp valve means to the clamp cylinders at a third pressure less than the first pressure, the second clamp valve means in its relief position releasing fluid from the clamp cylinders and from between the second clamp valve means and the clamp check valve means effective to reduce the pressure on the clamp cylinders to a pressure less than the third pressure when the first clamp valve means is also in its relief position.

4. The crusher of claim 3 including means remote from the crusher for controlling operation of the first and second clamp valve means between their respective clamp and relief positions, the remote control means being selectively effective: to dispose both clamp valve means in their clamp positions and thereby supply fluid at the third pressure to the clamp cylinders through the clamp check valve means and increase the same to the second pressure through the intensifier means; or to dispose the first clamp valve means in its relief position and the second clamp valve means in its clamp position and thereby deactivate the intensifier means and reduce pressure in the clamp cylinders to the third pressure; or to dispose both the first and second clamp valve means in their relief positions and thereby reduce the pressure in the clamp cylinders below the third pressure.

5. The crusher of claim 1 wherein the hydraulic adjust means includes a plurality of hydraulic bowl adjust cylinders interposed between the bowl and the frame effective to provide said bowl adjustment, each adjust cylinder including a piston and first and second chambers on opposite sides of the piston, a hydraulic pump for supply of fluid under pressure to the first and second chambers of the adjust cylinders, and hydraulic adjust valve means controlling supply of fluid from the pump to and from the adjust cylinders, the adjust valve means in a first position supplying fluid to the cylinder first chambers and releasing fluid from the cylinder second chambers effective to decrease said spacing, the adjust valve means in a second position supplying fluid to the cylinder second chambers and releasing fluid from the first chambers effective to increase said spacing, the adjust valve means in a third position retaining fluid in both the first and second cylinder chambers, and wherein the pump is also fluid connected to the first cylinder chambers in parallel with the adjust valve means through adjust check valve means effective to allow fluid flow to but not from the first cylinder chambers when the adjust valve means are in their third position.

6. The crusher of claim 5 wherein the pump supplies fluid at said first pressure to the adjust cylinders and wherein the first clamp valve means includes clamp and relief positions, the first clamp valve means when in its clamp position also supplying fluid to the adjust cylinders through the adjust check valve means, and when in its relief position relieving pressure on the adjust check valve means.

7. The crusher of claim 6 wherein the intensifier means comprises a stepped, closed end cylinder having first and second bores, the diameter of the first bore being greater than that of the second bore, first and second pistons respectively slidably operative in the bores, a first chamber in the cylinder between the first piston and the adjacent closed end of the first bore, a second chamber in the cylinder between the second piston and the adjacent closed end of the second bore, and a third chamber in the cylinder between the first and second pistons, the pistons being spaced from each other and interconnected through the third chamber for conjoint operation, the first clamp valve means in its clamp position also supplying fluid from the pump to the first chamber and releasing fluid from the third chamber effective to activate the intensifier means, the second chamber being fluid connected to the clamp cylinders, the first clamp valve means in its relief position supplying fluid to the third chamber and releasing fluid from the first chamber effective to deactivate the intensifier means and thereby reduce the pressure in the clamp cylinders.

8. The crusher of claim 7 including second hydraulic clamp valve means having clamp and relief positions disposed between the pump and the clamp cylinders and fluid connected to each in parallel with the intensifier means and the first clamp valve means, pressure reducing means disposed between the second clamp valve means and the clamp cylinders and clamp check valve means disposed between the pressure reducing means and the clamp cylinders effective to allow fluid flow to but not from the clamp cylinders, the second clamp valve means in its clamp position supplying fluid through the check clamp valve means to the clamp cylinders at a third pressure less than the first pressure, the second clamp valve means in its relief position releasing fluid from the clamp cylinders and from between the second clamp valve means and the clamp check valve means effective to reduce the pressure on the clamp cylinders to a pressure less than the third pressure when the first clamp valve means is also in its relief position.

9. The crusher of claim 8 including means at the crusher effective to monitor said spacing between the mantle and the liner and means remote from the crusher for controlling operation of the adjust valve means between its first, second and third positions and operation of the first and second clamp valve means between their respective clamp and relief positions, the control means being selectively effective: to dispose the adjust valve means in its third position and both clamp valve means in their clamp positions and thereby supply fluid at the third pressure to the clamp cylinders through the clamp check valve means and increase the same to the second pressure through the intensifier means; or to dispose the adjust valve means in its first or second position, the first clamp valve means in its relief position, and the second clamp valve means in its clamp position and thereby deactivate the intensifier means and reduce pressure in the clamp cylinders to the third pressure; or to dispose the adjust valve means in its first or second position and both the first and second clamp valve means in their relief positions and thereby reduce the pressure in the clamp cylinders below the third pressure.

* * * * *